US010668685B2

(12) United States Patent
Ronquist et al.

(10) Patent No.: US 10,668,685 B2
(45) Date of Patent: Jun. 2, 2020

(54) FOLDING ARRANGEMENT, FOLDING MACHINE AND METHOD FOR FOLDING

(71) Applicant: BERG INDUSTRIES AB, Stockholm (SE)

(72) Inventors: Olof Ronquist, Örebro (SE); Anneli Jonsson, Örebro (SE)

(73) Assignee: BERG INDUSTRIES AB, Stockholm (SE)

( * ) Notice: Subject to any disclaimer, the term of this patent is extended or adjusted under 35 U.S.C. 154(b) by 552 days.

(21) Appl. No.: 15/323,236

(22) PCT Filed: Jul. 1, 2015

(86) PCT No.: PCT/EP2015/064976

§ 371 (c)(1),
(2) Date: Dec. 30, 2016

(87) PCT Pub. No.: WO2016/001297

PCT Pub. Date: Jan. 7, 2016

(65) Prior Publication Data

US 2018/0009189 A1 Jan. 11, 2018

(30) Foreign Application Priority Data

Jul. 2, 2014 (SE) ..... 1450825

(51) Int. Cl.

| | |
|---|---|
| ***B31F 1/00*** | (2006.01) |
| ***B31B 50/58*** | (2017.01) |
| ***B31B 50/04*** | (2017.01) |
| *B31B 100/00* | (2017.01) |
| *B31B 120/30* | (2017.01) |
| *B31B 110/35* | (2017.01) |

(52) U.S. Cl.

CPC ..... *B31B 50/58* (2017.08); *B31B 50/042* (2017.08); *B31F 1/0022* (2013.01); *B31B 2100/00* (2017.08); *B31B 2100/0022* (2017.08); *B31B 2110/35* (2017.08); *B31B 2120/30* (2017.08)

(58) Field of Classification Search

None

See application file for complete search history.

(56) References Cited

U.S. PATENT DOCUMENTS

| | | | | |
|---|---|---|---|---|
| 4,614,512 A * | 9/1986 | Capdeboscq | ..... | B65H 45/22 198/405 |
| 7,708,679 B2 | 5/2010 | Cailloux et al. | | |
| 8,033,975 B2 * | 10/2011 | Wiklund | ..... | B31B 50/00 493/182 |

FOREIGN PATENT DOCUMENTS

DE 102004026690 B3 12/2005

OTHER PUBLICATIONS

Corresponding International Application PCT/EP2015/064976, International Search Report dated Sep. 16, 2015.

* cited by examiner

*Primary Examiner* — Hemant Desai
*Assistant Examiner* — Tanzim Imam
(74) *Attorney, Agent, or Firm* — Cooper Legal Group, LLC; Ronald M. Kachmarik

(57) ABSTRACT

A folding arrangement intended for folding of a continuous flow of box blanks. The folding arrangement includes: a feeding arrangement adapted to generate the continuous flow of box blanks through the folding arrangement and a folding unit. Also is a folding machine including the arrangement. Also is a method for adjustable folding of box blanks passing through the folding arrangement.

14 Claims, 5 Drawing Sheets

FOLDING ARRANGEMENT, FOLDING MACHINE AND METHOD FOR FOLDING

TECHNICAL FIELD

The present invention relates to a folding arrangement, a folding machine comprising said folding arrangemen and a method for folding of box blanks.

TECHNICAL BACKGROUND

Packages of different types and sizes made of corrugated cardboard, or corrugated paperboard, are used in many different areas to pack and protect different kinds of products.

The manufacturing of these packages is performed in substantially two steps, wherein the first step is to manufacture the corrugated paperboard, or cardboard, which in the end of the first step is cut or trimmed into a substantially flat sheet of corrugate paperboard of a predetermined shape. The sheets of corrugated paperboard may also already in the first step be provided with folding lines, also called grooves or scores, which commonly extend crosswise to the direction of corrugation of the corrugated paperboard. In the second step the corrugated paperboards is transformed to a product, for example a box, by cutting, grooving and folding thereby forming a box of the desired size and shape.

I all existing machines for making corrugated paperboard boxes on the market today, so called folding notches are made in the box blanks of the contemplated box before the folding begins in order to facilitate the precision of the folding. These folding notches are often called grooves, or scores, as stated above, and are placed along the contemplated line around which the panel is to be folded.

The actual folding is accomplished in a so called folding unit by which the box blanks are fed at an even rate. In the folding unit, belts and/or belts comprising shoulders are arranged to force the box blanks to fold along the folding notches.

Folding of box blanks utilizing rods and/or folding belts is an old conventional technique shown in for example U.S. Pat. No. 7,708,679. The problem of these solutions is that the rods and/or the folding belts normally influence the box blank unevenly during the folding process, commonly more at the front end of the box blank, which gives rise to an undesired phenomena known in the art as "fishtailing" which implies a certain undesired skewness between the different portions of the box blank after folding.

In more modern folding units the folding belts have been provided with shoulders which are arranged such that they operate in the centre of the box blank to be folded thereby reducing the problem of fishtailing. To ensure the best effect, the speed of the folding belts comprising shoulders should correspond to the speed of the box blanks such that the shoulder does not slide with respect to the sheet during the process, thereby avoiding friction between the shoulder and the sheet surface which aggravates the final folding result. Even if this solution lessens the problem of "fishtailing" there is still a need for an improved technology to increase the precision and quality of the resulting boxes.

SUMMARY OF THE INVENTION

The present invention, as defined by claim 1, relates to a folding arrangement for folding a continuous flow of box blanks which pass through the folding arrangement along a longitudinal direction L, said box blank comprising at least a first and a second portion arranged on either side of a substantially linear folding notch V and a first side face adapted to form an outer side after folding and a second side face adapted to form an inner side after folding, said folding arrangement allowing an optional folding of said second portion between 90° and 180° with respect to said first portion, along the folding notch V forming a folding line VL parallel to the longitudinal direction L of the folding arrangement.

The folding arrangement according to the invention comprises:

- a feeding arrangement adapted to generate the continuous flow of box blanks through the folding arrangement along the longitudinal direction L, said feeding arrangement comprising a first end in which the box blanks are guided into the folding arrangement, and a second end in which the folded box blank exits the folding arrangement, wherein the box blanks are fed through the folding arrangement such that said first portion is substantially horizontal and the folding notch V is parallel to the longitudinal direction L;
- a folding unit comprising:
- at least one folding belt which runs at least around a first wheel arranged upstream along the feeding arrangement and a second wheel arranged downstream along the feeding arrangement, said first wheel rotates around a first axle A1 pivotally mounted to said folding arrangement, said second wheel rotates around a second axle A2 and is adjustably mounted to the folding arrangement;
- at least one folding shoulder attached to the folding belt on the side of the folding belt facing away from said first and second wheel, said folding shoulder comprising a contact surface intended to bear against the first side face of said box blank during folding;
- a driving arrangement arranged to drive the folding belt at substantially the same speed as the speed by which the feeding arrangement transports the box blanks through the folding unit;
- wherein said contact surface of the folding shoulder, in a plane perpendicular to the direction of movement of the folding belt, has the shape of a convex circular arc; and
- wherein the second wheel and its axle of rotation A2 are movable along a curve in a plane perpendicular to the longitudinal axis L, said curve comprising a first end position corresponding to an angle of folding $\alpha$ of approximately 90° and a second end position corresponding to an angle of folding $\alpha$ of 180° and shaped such that the distance r between said folding line VL and the point of contact of the folding shoulder on the box blank (100) decreases with an increasing angle of folding $\alpha$.

The folding arrangement fulfills the objectives of increased precision and reduced risk of so called "fishtailing" described above by means of the ingenious curve of movement of the second wheel, which by means of its shape causes the contact surface of the folding shoulder to roll over the surface of the box blank instead of gliding during its movement from the first to the second wheel which thereby reduces the lateral forces on the box blank and the risk of the so called "fishtailing". The design of the curve of movement combined with the pivotably mounted first wheel implies that the belt and the folding shoulders, regardless of the selected folding angle in the interval, will move such that the contact surface of the folding shoulder substantially rolls over the surface of the box blank instead of gliding. The folding unit according to the invention thereby results in a very flexible design which regardless of angle of folding provides high precision folding which makes it flexible and suitable for use for several different types of boxes of different sizes and proportions.

In one embodiment of the folding arrangement, the contact surface of the folding shoulder has a radius of curvature in the interval of 15 to 50 mm. A radius of curvature within said rainge is very advantageous since it provides a larger contact, or bearing, surface against the box blank and thereby reduces the pressure load per unit of area on the box blank. A radius of curvature of said size has also proven to function well with other components of the folding unit.

In one embodiment of the folding arrangement, the distance r between the folding line and the contact surface of the folding shoulder at the first wheel is equal to the distance between the folding line and the contact surface of the folding shoulder at the second wheel when arranged in the position corresponding to a folding angle of 90°. A folding arrangement comprising these proportions provides the desired rolling of the box blank along the contact surface of the folding shoulder in a very advantageous way since the folding takes place in the folding unit.

In one embodiment of the folding arrangement a plurality of folding shoulders each comprising a contact surface are arranged equidistantly along the folding belt corresponding to the interval between successive box blanks. This embodiment ensures that the feeding of box blanks may be performed at a high velocity with preserved quality of folding.

In one embodiment of the folding arrangement, the position of the second wheel is adjusted by means of a positioning arrangement. This embodiment facilitates and makes the setting work more efficient since the selection of folding angle is made via a suitable interface of a control unit which thereafter controls the positioning arrangement and adapts the position of the second wheel based on the selected angle of folding. The positioning arrangement may be an electric motor and parts coupled thereto.

In one embodiment of the folding arrangement the distance between the first and the second wheel at least lies in the interval 1 m to 3 m. This length gives a suitable time/distance in order to be able to perform the desired folding in a safe and reliable manner.

One embodiment of the folding arrangement comprises at least one elongated beam parallel to the direction of feeding and a feeding belt arranged to be moved along the respective beam, said feeding belt is designed to grab the box blanks and move these through the folding arrangement. This is one example of how the folding arrangement may be designed in order to attain a required reliability of operation and precision.

In one embodiment of the folding arrangement, the curve along which the second wheel travels is non-circular in order to obtain the desired change of distance between the contemplated folding line and wheel.

In one embodiment of the folding arrangement, the curve along which the second wheel moves is elliptic. A movement of the second wheel along an elliptical curve gives the desired movement of the second wheel for increasing angles of folding.

One embodiment of the folding arrangement comprises a folding former arranged on the opposite side of the first portion of the box blank with respect to the feeding arrangement and comprises a folding line extending parallel to said folding notch on the other side of the box blank. The folding former stabilizes the box blank as the blank moves through the folding arrangement which further improves the precision of the folding.

In one embodiment of the folding arrangement said feeding arrangement, folding arrangement, folding unit and positioning arrangement are controlled by a control unit to secure that the parameters of the comprised components are controlled in a correct way and mutually consistent which is important in order to obtain the desired precision of folding. Off course, the desired and via a suitable interface communicated selected angle of folding is communicated to the control unit which performs the necessary adjustments of the comprised components.

The present devices also relates to a folding machine intended to fold initially substantially flat box blanks comprising at least a first and a second portion arranged on either side of a substantially rectilinear folding notch V and a first side face adapted to form an outer side after folding and a second side face adapted to form an inner side after folding. The folding machine comprises, arranged along the longitudinal direction L:

- a pre-folding unit by means of which the initially flat box blanks are fed and in which said first and second portions are folded respectively from said initially flat shape to a folding angle of approximately 90; and
- at least one folding arrangement according to claim 1 allowing a selectable folding angle $\alpha$ of said second portion between 90° and 180°.

One embodiment of the folding the pre-folding unit comprises a stationary folding rod arranged at an angle with respect to the folding line such that said folding rod bears against the second portion of the box blank and folds the second portion to a folding angle of approximately 90°. The folding rod is a simple and reliable solution to attain the initial folding of the second portion.

The present invention also relates to a method for adjustable folding of box blanks which are passing through a folding arrangement according to the definition above. The method comprises the steps of:

a) selecting a desired angle of folding $\alpha$ and communicating the selection to the control unit;
b) arranging said second wheel on the position along the curve corresponding to the selected folding angle $\alpha$;
c) feeding box blanks to the folding arrangement and synchronizing the speed and the position of the folding belt such that the contact surface of the folding shoulder bears near the centre of the second portion of the box blank along the folding line;
d) moving box blank and folding shoulder at approximately the same speed through the folding arrangement, such that the folding shoulder pushes the second portion of the box blank to the selected folding angle $\alpha$ by way of the contact surface of the folding shoulder rolling over the side face of the second portion when the box blanks is moved through the folding arrangement.

BRIEF DESCRIPTION OF THE DRAWINGS

The above as wells as further objectives of, features of and advantages with the present invention will become apparent when studying the following illustrative and non-limiting detailed disclosure of preferred embodiments of the present invention, with reference to the appended drawings.

All figures are schematic, not necessarily to scale, and generally only show parts which are necessary in order to elucidate the invention, wherein other parts may be omitted or merely suggested.

DETAILED DESCRIPTION

The present invention, as previously stated, relates to a folding arrangement adapted to be arranged in a folding machine. The folding arrangement and the folding machine are intended to be used for folding of boxes starting from box blanks of corrugated paperboard. In the figures box blanks, selected parts of the folding arrangement and folding machine are shown in order to elucidate the substantial features.

Manufacturing of boxes of corrugated paperboard is performed in two main steps. The first step involves the production of corrugated paperboard from rolls of paper, commonly three rolls, and thereafter cut or trim the paperboard into substantially flat sheets of corrugated cardboard, which after folding results in a box with the desired dimensions. Machines intended for this first step are not shown in the figures and are not described in detail in this application.

Figure 1:
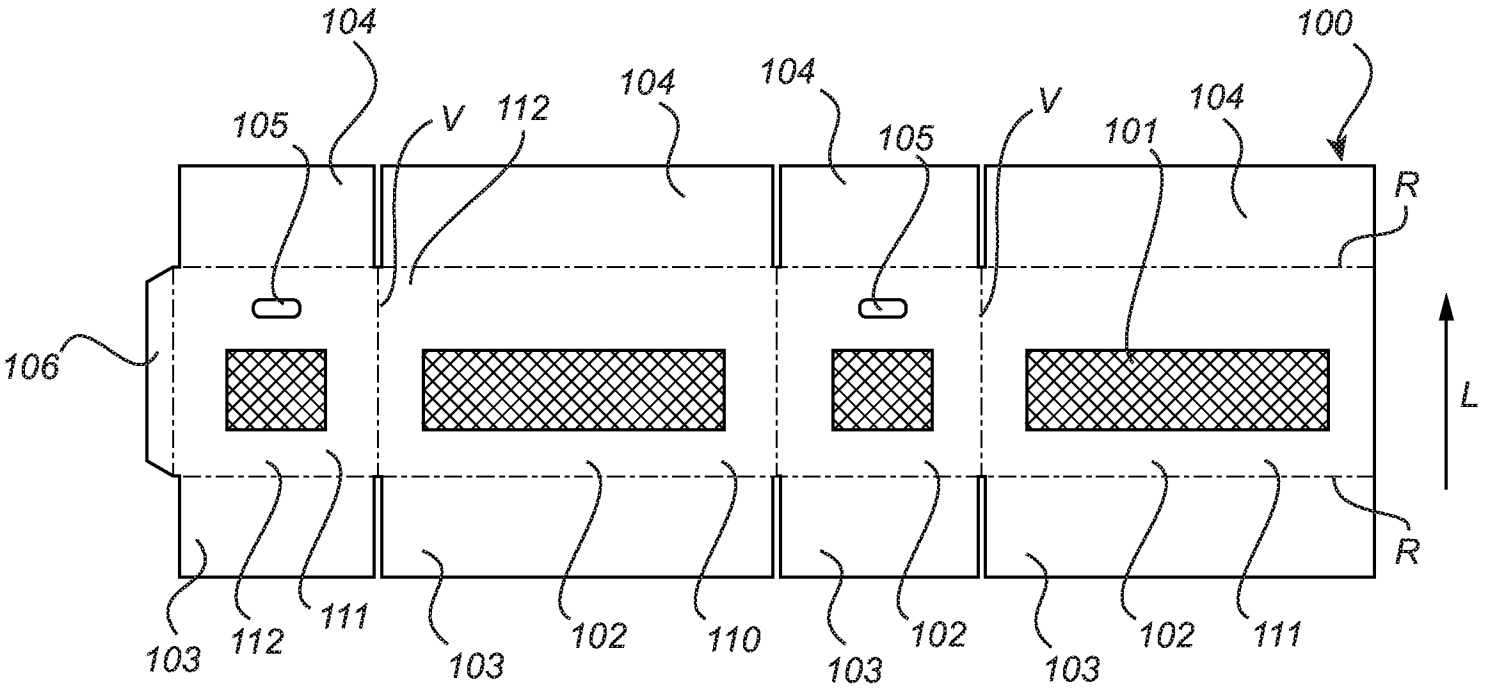
FIG. 1 illustrates a box blank before having passed the folding machine.

To facilitate the final folding of the top and bottom of the box after the box blanks has passed through the folding machine according to the invention so called grooves may be formed in the box blank. One conceivable variant of these grooves is shown in FIG. 1. The placement of the grooves is adapted to the desired size and shape of the box. Equipment to obtain these grooves/folding notches are not shown and described in this application since these are not related to the invention this application aims to protect and are well known in the art.

In the second step, the contemplated box is completed and one stage in this step is that the box blank passes a folding machine according to the invention. In the folding machine, the trimmed box blank is folded to form a box of a desired size and shape. The folding arrangement, and a folding machine comprising said folding arrangement according to the invention are intended to increase the precision of this folding and constitute a part of this second manufacturing step. Other units in this step are for example units for printing and punching of box blanks. These units are commonly arranged in a row along a common device arrangement for feeding the box blanks through the different units.

Figure 2:
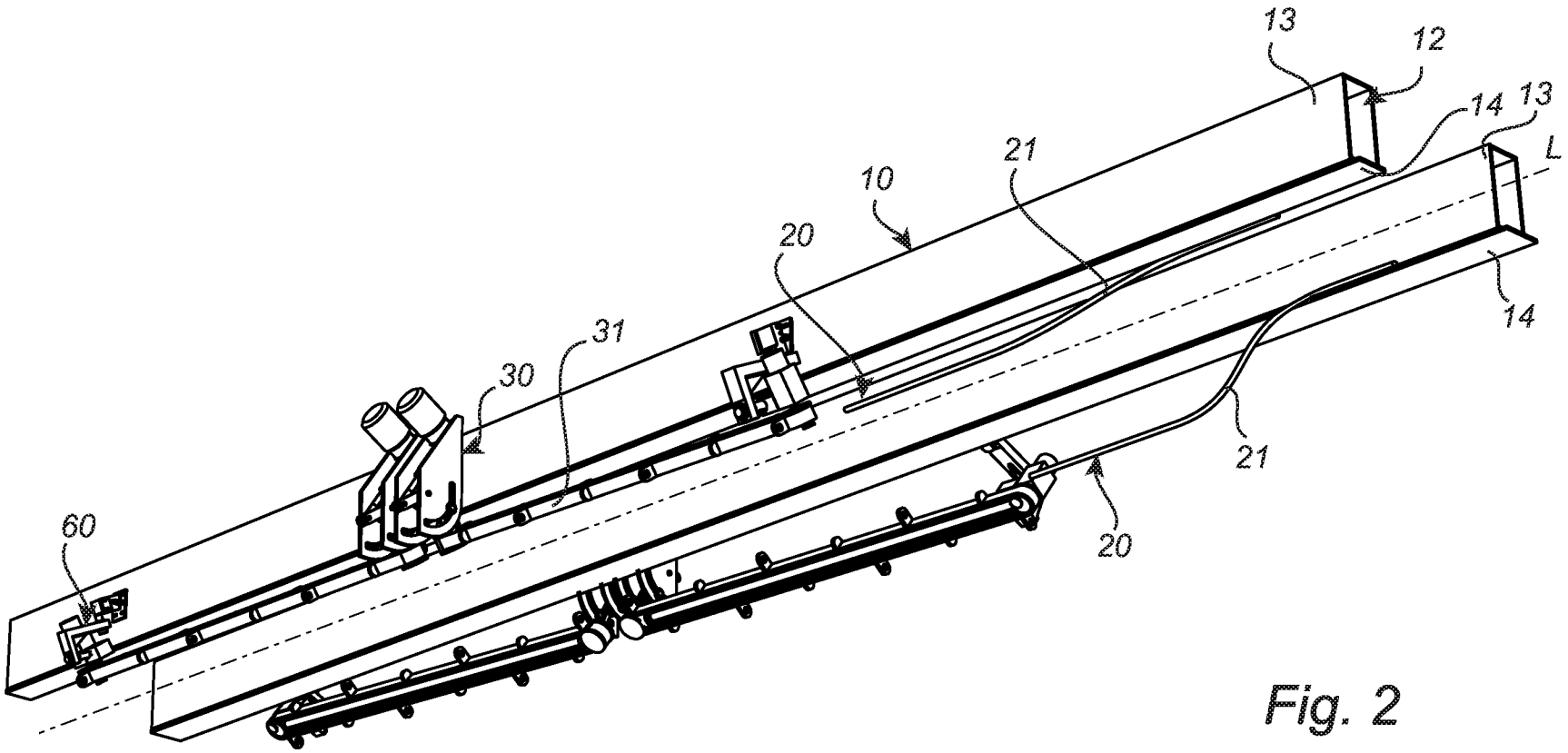
FIG. 2 illustrates selected components of the feeding arrangement, folding arrangement and pre-folding unit in perspective.
Figure 4:
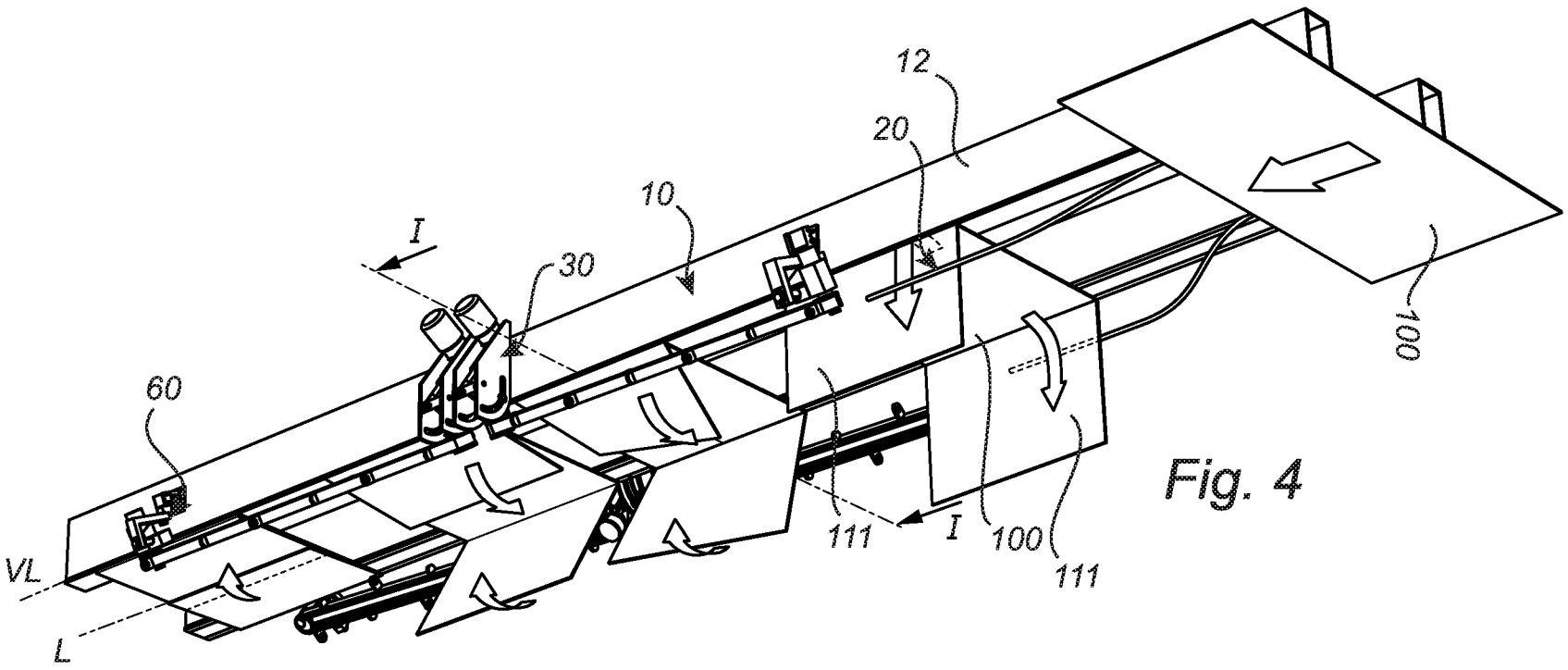
FIG. 4 shows a perspective view of selected components of the feeding arrangement, folding unit and the pre-folding unit and a number of different box blanks at different positions in the folding machine.

Selected parts of the folding arrangement and the folding machine according to the invention are shown in FIGS. 2 and 4, wherein a number of box blanks have been illustrated at different positions along their way through the folding machine as well.

The folding machine 10 comprises a longitudinal direction L1 which extends through the centre of the folding machine parallel to the feeding direction of the box blanks through the machine. The illustrated folding machine comprises, on either side of the longitudinal axis, substantially the same equipment arranged to perform analogous actions on the opposite sides of the box blank being moved through the folding machine 10. The description is therefore aimed at the equipment arranged along one of the sides of the machine.

Folding machines of this type have a considerable size and weight and the parts described in the following are all supported by a not illustrated support frame which is placed on substantially planar and stable ground.

Box Blank

FIG. 1 shows an example of a box blank 100 cut into a shape which after folding yields in a box of ordinary type. On the box blank 100, any contemplated décor 101 or text may be printed before folding since it is normally easier to print with a desired result before the box blank has passed the folding machine and obtained its contemplated shape.

The box blank 100 illustrated forms a rectangular box and therefore comprises four side section 102 forming the side walls of the box, four bottom sections 103 forming the bottom of the box and four top sections 104 which may be utilized for closing the box. I two opposite side section handles 105 have been cut out. The box blank further comprises an adhesive tongue 106 which after the folding of the box blank will bear against the inner or outer side of the neighboring side section such that these may be joined by a suitable joint such as an adhesive joint or an adhesive tape joint.

In order to elucidate the inventive conception and the definitions of the claims some other denominations are used for the parts of the box blank. The box blank therefore comprises a first portion 110 which during folding will be positioned substantially horizontal and run along the feeding arrangement of the folding machine and second portions 111 arranged on each side of the first portion. The second portions are the portion being folded with respect to the first portion when the box blanks passes through the folding machine.

A substantially rectilinear folding notch V runs between the first and the second portion to facilitate folding with good precision along the folding notch. The folding notch V is arranged in parallel with the longitudinal direction L of the device during the movement of the box blank through the device, i.e. the feeding direction, and forms a folding line VL parallel to the longitudinal direction L of the folding machine.

The initially flat box blank also comprises a first side face 112 and a second side face. After the passing of the box blank through the folding machine, the first side face 112 will make up the outer side of the box and the second side face the inner side of the box.

In the following, the invention and the method for folding is described with reference to one of these second portions 111.

Feeding Arrangement

The folding machine 10 comprises a feeding arrangement 12 which in the illustrated machine is made up by two longitudinal beams 13 which extend in parallel to the longitudinal axis L of the folding machine. The distance between the beams may be varied in order to be adapted the machine to different size box blanks. The beams 13 are straight and extend along the total length of the feeding arrangement. The beams 13 comprise rectangular cross sections wherein two of the sides are substantially horizontal and two vertical. Feeding belts 14 run along the lower sides of the beams 13 and move at a desired feeding speed such that the box blanks are transported at a desired speed along the lower side of the beams. The belts are endless and run around a drive wheel and a number of return wheels arranged in the respective ends of the folding machine and at selected positions along the extension of the belts through the folding machine, these components are not shown. The box blanks are held in place against the feeding belt 14 along the lower side of the beam by means of a negative air pressure in the beam and openings in the feeding belt 14 and the lower side of the beam, such that the box blank is sucked to the belt 14 and the beam 13 and thereby held in place during the movement through the folding machine. The negative pressure is generated by a pump arrangement, not shown, lowering the pressure in the beam.

The box blanks are placed with the side intended to form the outside of the finished box facing the feeding belt and the second portion is folded downwards, inwards with respect to the first portion. The feeding arrangement may be modified in many different ways, such as for example by allowing the box blanks to be moved along the top side of the beams, by changing the design of the feeding belts or the pump arrangement within the scope of the invention.

Folding Angle

To elucidate the functionality of the invention a folding angle $\alpha$, or angle of folding $\alpha$, is defined as the angle between a plane through the first portion 110 of the blank, arranged substantially horizontally in the folding machine, and a plane through the second portion 111 of the box blank. That is, a substantially flat box blank has a folding angle $\alpha=0°$. The folding angle $\alpha$ is shown in for example FIG. 5.

Pre-Folding Unit

The initial folding is performed in the so called pre-folding unit 20. In the pre-folding unit, the second portion 111 of the box blank is folded from the folding angle $\alpha=0°$ to approximately $\alpha=90°$. The pre-folding unit comprises a bent rod 21 which extends along the side of the feeding arrangement. At the upstream end of the pre-folding unit the rod is arranged at the same level as the feeding belt of the feeding arrangement at the upper side of the box blank. The rod 21 is bent somewhat downwards and extends along the side of the feeding arrangement in order to force the second section 111 downwards as the box blank 100 is moved through the folding machine and thereby generate the initial folding. The rod 21 continues downwards until the second portion 111 of the box blank 100 has reached the folding angle $\alpha=90°$. The disclosed initial folding is relatively easy to perform since the second portion of the box blank is folded downwards in joint action with the force of gravity and the folding rod 21 which implies a small risk of "fishtailing". This initial folding of the box blank is shown in FIG. 3.

An alternative embodiment of the pre-folding unit comprises a folding belt, with or without folding shoulders, as described in the initial section of this patent application instead of folding rods in order to generate the desired folding of the second portion of the box blank. The described conventional folding belts provide a satisfactory result since the risk of "fishtailing" during this initial folding is small.

Folding Former

In order to obtain a folding of high precision a folding former is arranged in the opposite side of the first portion of the box blank with respect to the feeding unit. The folding former extends in parallel to said folding notch between the first and the second portion of the box blanks and the feeding arrangement on the opposite side of the box blank. The folding former guides the box blanks in the desired direction and hold them in place in order to ensure that the folding is made at the folding notch in the box blank. The folding former comprises a folding edge which is arranged somewhat inside of the folding line of the box blank to provide support during the folding without interfering or hindering the actual folding between the first and second portions of the box blank.

Folding Unit

Different views of the folding unit 30 are illustrated in FIGS. 2 to 5. A folding unit 30 is placed on each side of the beams 13 comprised in the feeding arrangement 12, downstream of the pre-folding units 20 along the sides of the beams of the feeding arrangement facing away from one another. The folding unit 30 allows a selectable folding angle $\alpha$ in the interval 90° to 180°. The lower bound of the interval must correspond to the folding angle obtained in the pre-folding unit 20 and may be varied somewhat as long as the pre-folding unit and the folding unit are adapted to one another.

The folding unit comprises a folding belt 31 which runs around at least a first wheel 32 arranged upstream along the feeding arrangement and a second wheel 33 arranged downstream along the feeding arrangement. The folding belt 31 is an endless belt which runs along the beam 13 at a continuous speed corresponding to the feeding speed of the box blanks. A number of folding shoulders 34 are attached to the folding belt 31 on the side of the folding belt facing outwards from the first 32 and second 33 wheel. All folding shoulders 34 comprise a contact surface 35 adapted to bear against the first side face 112 of the box blanks during folding and push the second portion 111 inwards in order to obtain the desired folding angle $\alpha$ when the box blank 100 reaches the second wheel 33.

The design of the folding shoulders 34 may vary, as long as all folding shoulders have the same shape and size. The contact surface 35 has the shape of a convex circular arc arranged in a plane perpendicular to the direction of movement of the folding belt. The circular arc suitably has a radius of curvature within the interval of 15 mm to 50 mm and is place centered on the belt such that the radius of curvature is constant over the width of the belt. The circular arc is arranged with the convex side facing the box blank such that the rounded contact surface apply a gentle force on the box blank. The illustrated embodiment of the folding belt 31 furthermore comprises smaller supporting shoulders 36 arranged between the folding shoulders 34 with the purpose of stabilizing the folding belt and the second portions 111 of the box blank during folding. These supporting shoulders may bear against the box blank 100.

The first wheel is attached to the folding machine 10 by means of an attachment mechanism 40 and rotates around a first axis A1. The first wheel is arranged such that the contact surfaces of the folding shoulders meet the second portion 111 of the box blanks as it passes the first wheel 32. If the first wheel is erroneously arranged with respect to the downstream end of the pre-folding unit, there is a risk for damage on the box blank.

The straight line extending between the centre points of the first 32 and the second wheel 33 defines an axis A4. A third axis A3 is perpendicular to both A1 and A4 and when a folding shoulder of the belt is arranged aligned with A3, i.e. the folding shoulder 34 and the contact surface 35 are arranged in a plane through A3, and facing said feeding arrangement 12, and the second portion 111 of the box blank 100, there is a contact pointbetween the contact surface 35 and the box blank. The contact point in this plane is fixed and the attachment mechanism 40 aims to make it possible for the first wheel 32 to adjust to the position of the second wheel 33 without changing this contact point. The defined contact point is thereby fixed with respect to the feeding arrangement.

The attachment mechanism allows a rotation of the first wheel 32 relative to axes parallel to A1 and A3 but prevents rotation around an axle parallel to A4, such that the axis A4 may be arranged in an arbitrary angle within a certain interval and the angular position of the first wheel is adapted to this movement which ensures that the folding belt 31 is maintained substantially straight between the first 32 and second 33 wheel.

Adjacent to the first wheel 32, a driving arrangement 37 is arranged to drive the folding belt 31 at a desired speed via the first wheel 32. The driving arrangement 35, schematically illustrated in for example FIGS. 3*a* and 3*b*, may be of different types, suitable is some kind of electric motor connected to the driving axle of the first wheel to drive the first wheel 32 via the axle. The driving unit 37 is also supported by the attachment mechanism of the first wheel to allow the movement of the first wheel 32 described above.

The second wheel 33 is attached to the folding machine downstream of the first wheel 32 along the feeding arrangement 12. The second wheel 33 is rotated around a second axis A2 which is movably arranged in a plane transverse to the longitudinal axis L of the folding machine 10 such that the second wheel 33 and its axis of rotation A2 are moved along a predetermined curve 42 comprising a first end position 43 corresponding to a folding angle of approximately 90° and a second end position 44 corresponding to a folding angle of 180°.

As described, the attachment mechanism of the first wheel 32 allows a rotation of the first wheel 32 relative to axes parallel to A1 and A3 but prevents rotation around an axle parallel to A4 defined by the straight line extending between the centre points of the first 32 and the second wheel 33. Thereby, and due to the movable arrangement of the axis A2 of the second wheel 33 described above, the axis A4 may be arranged in an arbitrary angle within a certain interval, (with respect to the longitudinal axis L and/or the transverse plane defined above), whereby the angular position of the first wheel may be adapted to the movement of the second wheel 33 and its axis of rotation A2 along the predetermined curve 42 to ensure that the folding belt 31 is maintained substantially straight between the first 32 and second 33 wheel.

The curve, which is non-circular, is shaped and arranged such that the distance between said folding line VL and the contact point of the folding shoulder on the second portion 111 of the box blank decreases with an increasing folding angle $\alpha$. The curve may be a part of an elliptical curve.

Figure 5:
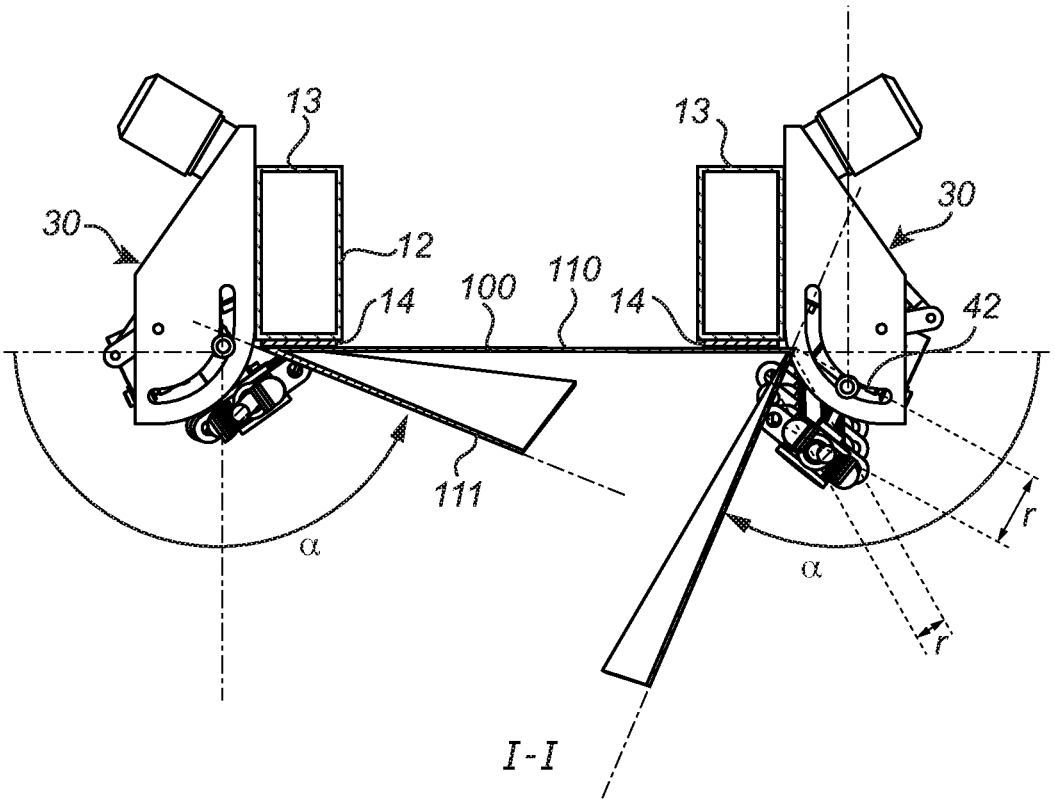
FIG. 5 is a cross sectional view through I-I of FIG. 4. I-I is perpendicular to the longitudinal axis of the folding machine.

A curve of movement comprising these characteristics combined with the contact surface 35 of each folding shoulder 34 implies that the contact surface of the folding shoulder will roll over the surface of the second portion 111 of the box blank instead of gliding during folding, thereby reducing the influence on the box blank 100 and thereby reducing the problem of skewness in the folding, so called fishtailing. The reduction of distance $\Delta r$ between the folding line VL and the point of contact between the contact surface 35 of the folding shoulder 34 and the second portion 111 of the box blank 100 from the end position corresponding to a folding angle $\alpha=90°$ to $\alpha=180°$ is within the interval of 0 mm$<\Delta r<$50 mm. The reduction of distance occurs substantially proportional to a selected folding angle $\alpha$. The distance between the contact surface of the folding shoulder and the folding line VL is shown in FIG. 5 for a number of folding angled in order to elucidate the principle of the invention for which a patent is applied. In FIG. 5, the distance r1 and r2 are illustrated for two different angles as an example of different possible positions for the second wheel. In FIG. 5, r1 corresponds to a smaller folding angle and r2 a larger folding angle. Further positions of the second wheel are illustrated in FIG. 5 as well.

Figure 3A:
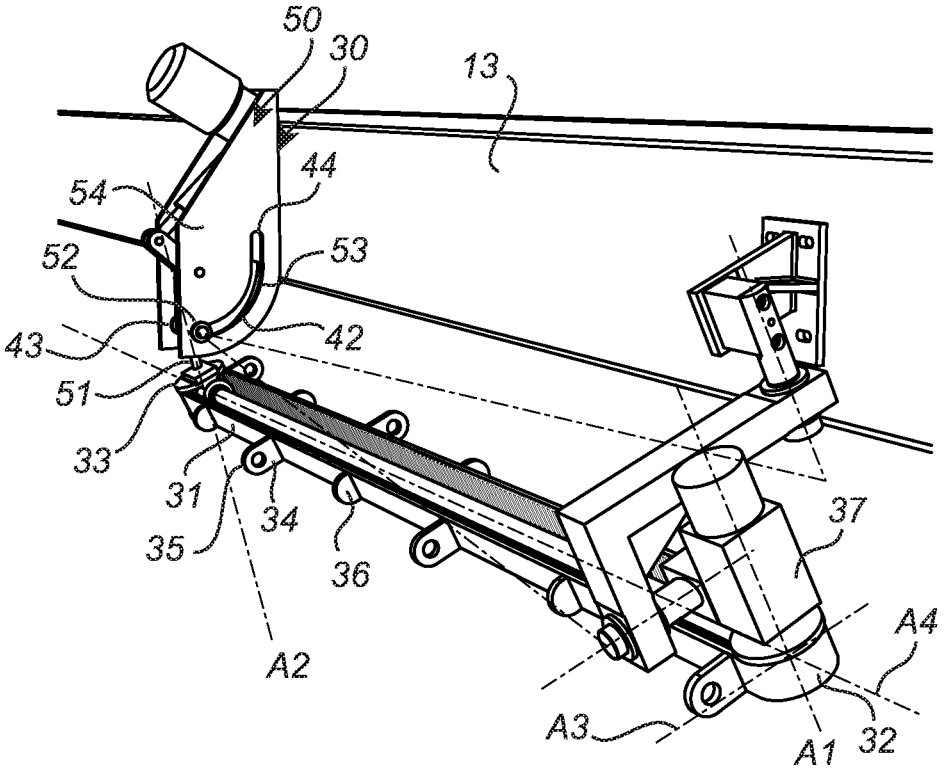
FIG. 3*a* illustrates a folding arrangement according to the invention arranged for a first folding angle in perspective.
Figure 3B:
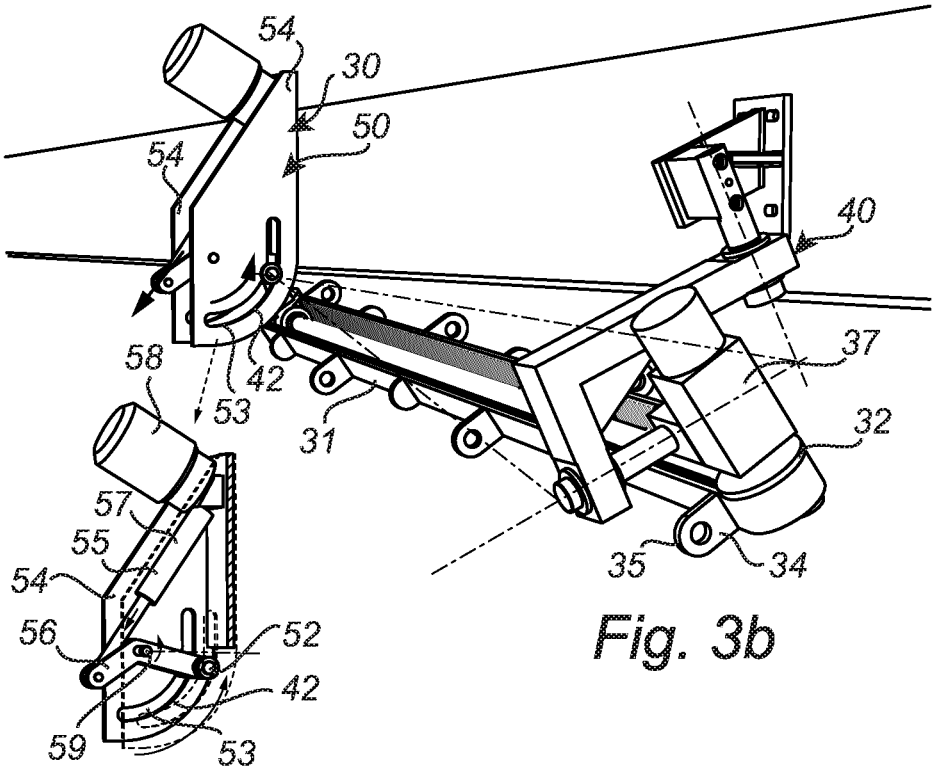
FIG. 3*b* illustrates the folding arrangement of FIG. 3*a* positioned for a different folding angle.

This is possible by means of the attachment device 50 shown in FIGS. 3*a* and 3*b*. The axle of rotation 51 of the second wheel, coaxial to the axis A2, is attached to a transverse axle 52 arranged substantially parallel to the longitudinal axis of the folding machine. The transverse axle 52 is arranged in a corresponding guiding groove 53 in two substantially planar plates 54 comprising a rather plate like shape and attached to the beam 13 of the feeding arrangement on a predetermined distance from one another, which is less than the length of the transverse axle 52. The plates 54 are arranged substantially transverse with respect to the beam 13 and the transverse axle 52, and the thereto coupled second wheel 33 may thereby be moved along the guiding grooves 53 whose shape and extension corresponds to the desired curve of movement 43 of the second wheel 33.

The desired movement of the second wheel 33 is obtained by means of a positioning arrangement 55 arranged adjacent to the second wheel 33. The positioning arrangement 55 comprises a movable displacement arm 56 movably arranged in substantially the same plane as the axis of rotation A2 of the second wheel. One end of the displacement arm 56 is connected to the transverse axle 52 and the other end is connected to a driving arrangement 57 which may be for example an electric motor 58 or a hydraulic cylinder. The displacement arm 56 is close to its centre movably attached to the transverse plates 54 such that it may be turned around the attachment point 59 by means of the driving arrangement 57. When the displacement arm 56 is displaced, the transverse axle 52 and the second wheel 33 will be displaced along the guiding groove 53 in the two transverse plates 54. Since the attachment of the displacement arm to the transverse plates does not constitute the centre of the guiding grooves, the attachment of the displacement arm in the middle of the arm is movable such that the transverse axle is allowed to follow the guiding grooves in the transverse plates.

Control Unit

The folding machine comprises a plurality of components each requiring control in order to function. The folding machine therefore comprises a control unit controlling and steering the different parts comprised in the folding machine 10 according to the selected folding angle. For example, the control units controls the feeding arrangement 12 such that a desired feeding speed of box blanks 100 is obtained as well as adjusts the feeding arrangement to different box sizes and/or shapes, the different actions of the folding arrangement 30 such as the speed of the folding belt 31 and the adjustment of the position of the second wheel 33 based upon to the desired folding angle $\alpha$.

The control unit further comprises an interface for controlling/programming of the folding machine 10 for setting the desired type of box, size etc.

The Folding Machine

In the foregoing the different parts comprised in the folding unit 30 according to the invention has been described in detail. The folding unit 30 is included as one of the parts of a folding machine 10.

The embodiment of the folding machine 10 shown in FIGS. 2 and 4 comprises an additional embodiment of the folding unit according to the invention arranged downstream of the folding unit 30 described above. This second folding unit 60 also comprises a pivotally attached wheel of the same design as the first wheel 32 described above and a wheel movable along a convex curve of the same design as the second wheel 33 described above and thereto belonging parts for adjusting the position of the wheel. The same types of folding belts, folding shoulders and contact surfaces are used in this second folding unit.

However, in this second folding unit 60, the movable wheel 61 is arranged upstream of the pivotally attached wheel 62 near the second wheel 33 of the first folding unit 30 but on such a distance that the folding shoulders 34 of the folding belts does not come into contact with one another. The downstream pivotably attached wheel constitutes the final folding station of the folding machine 10 and the wheel 62 is arranged such that second portion 111 of the box blank has a folding angle $\alpha=180°$ at the pivotally arranged wheel. The position of the upstream movable arranged wheel 61 is controlled by the control unit described above and shall correspond to the position of the second wheel 33 of the first folding unit 30.

The folding machine comprising these two folding units arranged in rows on each side of the feeding arrangement described above is very advantageous since it enables folding of more complex box shapes where the different portions, or sections, of the box blank comprise such lengths/shapes that they risk blocking one another during folding and overlapping after folding.

The first wheel 32 has a fixed angle and the pivotably arranged wheel 62 belonging to the second folding unit is fixed preferably at approximately 90 degrees with respect to one another.

In other words, a plane parallel to the longitudinal direction L wherein the axis A1 of the first wheel is arranged, and the corresponding plane wherein the corresponding axis of the wheel 62 belonging to the second folding unit is arranged are fixed at a relative angle of approximately 90 degrees with respect to one another.

The first and the second folding units on each side of the feeding arrangement may be controlled by the control unit such that most of the folding of the second portion of the box blank on the one side of the feeding arrangement is performed at the downstream end of the folding machine whereas on the other side most of the folding of the corresponding second portion is performed directly downstream of the pre-folding unit.

This enables the folding of for example a long overlapping second portion behind, or inside of, a shorter opposite second portion in an easy way and with high precision.

Accordingly, if the folding machine is used for manufacturing of boxes where sections, or portions, to be folded are at risk of collide and block each other different folding angles $\alpha$ are set for the movable wheels on the different sides of the feeding arrangement. Thereby, the portion of the box blank on the one side of the feeding arrangement may be folded before the portion of the box blank on the other side such that the risk of the portions blocking one another is eliminated which increases the degree of reliability of the device considerably. This method for folding of box blanks is shown in FIG. 4 wherein it is clearly shown that the second portion on the one side of the feeding arrangement is folded to a folding angle wherein it does not risk to interfere with the second portion on the opposite side of the box blank before the second portion on the opposite side is folded.

When the box blanks are fed though the second folding unit the portions on each side of the feeding arrangement are folded to a folding angle $\alpha=180°$.

Also in the second folding unit the goal is that the contact surfaces of the folding shoulder rolls over the surface of the box blank since the components comprised in the folding unit have the same configuration as in the first folding unit.

In order to clearly illustrate the functionality of the folding unit the illustrations are simplified and need not be to scale, for example some measurements may be exaggerated in order to illustrate some features.

In the appended drawings one embodiment of the folding unit and folding machine according to the claims is illustrated. A plurality of the component of the folding unit and the folding machine may however be modified in a plurality of ways without departing from the scope of the invention as defined by the appended claims.

The invention claimed is:

1. Folding arrangement intended for folding of a continuous flow of box blanks passing through the folding arrangement along a longitudinal direction, each box blank comprising at least a first portion and a second portion arranged on either side of a linear folding notch and a first side face adapted to form an outer side after folding and a second side face adapted to form an inner side after folding, said folding arrangement allowing an optional folding of said second portion between 90° and 180° with respect to said first portion along the folding notch forming a folding line parallel to the longitudinal direction of the folding arrangement, wherein said folding arrangement comprises:

a feeding arrangement adapted to generate the continuous flow of box blanks through the folding arrangement along the longitudinal direction, said feeding arrangement comprising an upstream end in which the box blanks are guided into the folding arrangement, and a second end in which a folded box blank exits the folding arrangement, wherein the box blanks are fed through the folding arrangement such that said first portion is horizontal and the folding notch is parallel to the longitudinal direction;

a folding unit comprising:

at least one folding belt which runs at least around a first wheel arranged upstream along the feeding arrangement and a second wheel arranged downstream along the feeding arrangement, said first wheel rotates around a first axle and is pivotally mounted on said folding arrangement, said second wheel rotates around a second axle and is adjustably mounted on the folding arrangement;

at least one folding shoulder attached to the at least one folding belt on a side of the at least one folding belt facing away from said first and second wheels, said at least one folding shoulder comprising a contact surface intended to bear against the first side face of said box blank during folding;

a driving arrangement arranged to drive the at least one folding belt at the same speed as a speed by which the feeding arrangement transports the box blanks through the folding arrangement;

wherein said contact surface of the at least one folding shoulder, in a plane perpendicular to a direction of movement of the at least one folding belt, has the shape of a convex circular arc; and wherein the second wheel and the second axle are moved along a non-circular curve in a plane perpendicular to a longitudinal axis of the folding arrangement, said curve comprising a first end position corresponding to a folding angle of 90° and a second end position corresponding to a folding angle of 180° and is shaped such that a distance between said folding line and a point of contact of the at least one folding shoulder on the box blank decreases with an increasing folding angle.

2. Folding arrangement according to claim 1, wherein the contact surface of the at least one folding shoulder has a radius of curvature of 15 to 50 mm.

3. Folding arrangement according to claim 1, wherein a distance between the folding line and the contact surface of the at least one folding shoulder at the first wheel equals the distance between the folding line and the contact surface of the at least one folding shoulder at the second wheel when arranged in a position corresponding to a folding angle of 90°.

4. Folding arrangement according to claim 1, wherein the at least one folding shoulder comprises a plurality of folding shoulders each comprising a contact surface, the plurality of folding shoulders being arranged at regular intervals along the at least one folding belt, corresponding to intervals between successive box blanks of the feeding arrangement.

5. Folding arrangement according to claim 1, wherein a position of the second wheel is adjusted by means of a positioning arrangement.

6. Folding arrangement according to claim 1, wherein a distance between the first wheel and the second wheel is 1 m to 3 m.

7. Folding arrangement according to claim 1, wherein the feeding arrangement comprises at least one elongated beam parallel to a direction of feeding and a feeding belt arranged to be moved along the at least one elongated beam, said feeding belt being designed to grab the box blanks and move these through the folding arrangement.

8. Folding arrangement according to claim 1, wherein the curve includes more than one radius.

9. Folding arrangement according to claim 1, wherein the curve is elliptic.

10. Folding arrangement according to claim 1, wherein the folding arrangement comprises a folding former arranged on an opposite side of the first portion of the box blank with respect to the feeding arrangement and comprising a folding edge extending parallel to said folding notch.

11. Folding arrangement according claim 5, wherein said feeding arrangement, said folding arrangement, said folding unit and said positioning arrangement are controlled by a control unit.

12. Folding machine intended to fold initially flat box blanks each comprising at least a first portion and a second portion arranged on either side of a rectilinear folding notch and a first side face adapted to form an outer side after folding and a second side face adapted to form an inner side after folding, wherein said folding machine comprises, arranged along a longitudinal direction:

a pre-folding unit by means of which initially flat box blanks are fed and said first and second portions are folded respectively from an initially flat shape to a folding angle of 90°; and at least one folding arrangement according to claim 1 allowing a selectable folding angle of said second portion between 90° and 180°.

13. Folding machine according to claim 12, wherein the pre-folding unit comprises a stationary folding rod arranged at an angle with respect to the folding line such that said folding rod bears against the second portion of the box blank and folds the second portion to a folding angle of 90°.

14. Method for adjustable folding of box blanks passing through a folding arrangement according to claim 1, through which box blanks pass along a longitudinal direction, each box blank comprising at least a first portion and a second portion arranged on either side of a rectilinear folding line and a first side face adapted to form an outer side after folding and a second side face adapted to form an inner side after folding, said method allowing a selectable folding of said second portion of between 90° and 180° with respect to said first portion, and comprising the steps of:

a) selecting a desired folding angle and communicating the selected desired folding angle to a control unit;

b) arranging said second wheel in a position along the curve corresponding to the selected desired folding angle;

c) feeding box blanks through the folding unit and synchronizing a speed and a position of the at least one folding belt such that the contact surface of the at least one folding shoulder bears near a center of the second portion of the box blank along the folding line;

d) moving the box blank and the at least one folding shoulder at the same speed through the folding arrangement, such that the at least one folding shoulder pushes the second portion of the box blank to the selected folding angle by way of the contact surface of the at least one folding shoulder rolling over a side face of the second portion when the box blank is moved through the folding unit.

* * * * *